US005933060A

United States Patent [19]

Qvist

[11] Patent Number: 5,933,060

[45] **Date of Patent: *Aug. 3, 1999**

[54] WAVEGUIDE CIRCULATOR HAVING PISTON MOVABLE AGAINST FERRITE PUCK

[75] Inventor: Jan Anders Qvist, Kungsbacka, Sweden

[73] Assignee: Telefonaktiebolaget LM Ericsson, Stockholm, Sweden

[ * ] Notice: This patent is subject to a terminal disclaimer.

[21] Appl. No.: 09/128,471

[22] Filed: Aug. 4, 1998

Related U.S. Application Data

[63] Continuation of application No. 08/858,456, May 19, 1997, abandoned.

[30] Foreign Application Priority Data

May 20, 1996 [SE] Sweden ..... 9601904

[51] Int. Cl.[6] ..... H01P 1/39

[52] U.S. Cl. ..... 333/1.1; 333/24.1

[58] Field of Search ..... 333/1.1, 24.1–24.3, 333/102, 158, 248

[56] References Cited

U.S. PATENT DOCUMENTS

| | | | |
|---|---|---|---|
| 3,105,206 | 9/1963 | Bosset et al. | 333/1.1 |
| 3,573,666 | 4/1971 | Caffrey et al. | 333/1.1 |
| 3,701,054 | 10/1972 | Hagler et al. | 333/1.1 |
| 3,854,106 | 12/1974 | Tresselt | 333/1.1 |
| 4,240,049 | 12/1980 | Kostelnick | 333/1.1 |
| 4,254,384 | 3/1981 | Piotrowski et al. | 333/1.1 |
| 4,276,522 | 6/1981 | Coerver | 333/1.1 |
| 5,153,537 | 10/1992 | Desmarest | 333/1.1 |

FOREIGN PATENT DOCUMENTS

| | | | |
|---|---|---|---|
| 2 659 499 | 9/1991 | France . | |
| 52-55355 | 5/1977 | Japan . | |
| 1374210 | 11/1974 | United Kingdom | 333/1.1 |

OTHER PUBLICATIONS

International–Type Search Report corresponding to National Application No. 9601904–7, mailed Feb. 2, 1997.

"Common Waveguide Circulator Configurations", *Electronic Engineering*, Sep. 1974, pp. 66–69.

*Primary Examiner*—Paul Gensler

*Attorney, Agent, or Firm*—Burns, Doane, Swecker & Mathis, L.L.P.

[57] ABSTRACT

The present invention relates to circulators for microwave frequencies and higher frequencies. The circulator (100;200;300) of the invention comprises a waveguide system, the waveguide system being situated in a waveguide house. A hole (111,211,311) is arranged in a first waveguide wall (171;271;371) of the waveguide system. A tubular piston (114;214;314) is arranged so that it can slide in the hole. A package, comprising ferrite material (132,135;235, 235;332,335) in the shape of pucks, is arranged between a second waveguide wall (174;274;374) and the tubular piston, the second waveguide wall being opposite to the first waveguide wall. The tubular piston is pressed in the direction of the package. That end (117;217;317) of the tubular piston that faces away from the second waveguide wall is open, and slits (120;220;320) are arranged at this end, the slits stretching mainly in the direction of the tubular piston. A pressing element (156;255,260;355,360,364) presses the edge (165;265;365) of the end with the slits against the walls of the hole, resulting in a good mechanical and galvanic contact between the piston and the walls of the hole. The distance from the edge to the first waveguide wall is one half of the working wavelength of the circulator.

26 Claims, 3 Drawing Sheets

WAVEGUIDE CIRCULATOR HAVING PISTON MOVABLE AGAINST FERRITE PUCK

This application is a continuation of application Ser. No. 08/858,456, filed May 19, 1997 abandoned.

TECHNICAL FIELD

The present invention relates to the field of components intended for use in waveguide systems for frequencies in the microwave range and higher frequency ranges where the phase shifting ability of a ferrite substance placed in a magnetic field is utilized.

STATE OF THE ART

In communication systems, such as, for instance, radio links, waveguide systems of different kinds are used to a great extent for transmission and signal processing of microwaves. With microwaves here and in the following is meant signals with frequencies within the microwave range as well as signals with higher frequencies, for example within the millimetre wave range.

The circulator is a component used in these situations, which has the property that it transmits microwave signals between certain of the waveguide ports (connections) comprised in the circulator, while other routes are blocked. In a circulator with three ports, a signal fed to port 1 is thus transmitted to port 2, a signal fed to port 2 is transmitted to port 3, and a signal fed to port 3 is transmitted to port 1, while the signals in the opposite direction are strongly attenuated, whereby an isolation between the ports is achieved.

In the circulator, the property of a ferrite substance to phase shift microwave signals passing the ferrite, under the influence of a magnetic field is utilized. By dimensioning the ferrite substance, the magnetic field, the dielectric, and other things, suitably, the properties described above can be achieved.

A large number of different embodiments of circulators with ferrite substances are known. Thus, as an example, reference is made to an overview of circulators of the junction type in the magazine Electronic Engineering, September 1974, pp. 66–68. Common to these circulators is that combinations of ferrite substances and dielectric substances are placed between the walls of the waveguide. For adapting the impedance of the circulator to the waveguides connected to it, an impedance transformer is normally placed adjacent to the ferrite substance.

To achieve good electric properties in the form of low insertion loss and high isolation combined with a large bandwidth, among other things, high requirements are placed on the mechanical dimensions and positioning of the included components. This is especially important for signals in the millimetre range where the components become very small. As it is necessary to fix the component, gluing is much used, which makes it hard to carry out subsequent adjustments. This also means that the mounting work when manufacturing the circulator becomes complicated and that the error frequency becomes high. The result is that it becomes expensive to manufacture the circulator.

In the abstract of the Japanese patent specification No. 52-55355 a circulator for which the mounting work has been somewhat simplified is described. A package comprising a ferrite substance in the shape of a puck has here been mounted on a fixing part which has then been introduced into the waveguide through a hole in one of the waveguide walls. The fixing part presses the packet towards the opposite waveguide wall so that the package is in this way kept in place in the waveguide. A flange at the fixing part lies in contact with an edge positioned in the hole to which it is also fixed with a screw.

Although this construction of a circulator simplifies the mounting, it also has certain disadvantages. The position of the fixing part is determined as it is screwed to the edge of the hole, and thereby the distance between the fixing part and the opposite waveguide wall is determined. As good contact between the waveguide wall and the package of ferrite substance is important, and the ferrite substance is also easily damaged by a too high mechanical pressure, high requirements must be made on the dimensions of the package and the fixing part. Temperature variations may lead to increased tensions in the ferrite substance or play between the package and the waveguide wall, depending on the coefficients of linear expansion of the comprised parts.

Another type of circulator is obtained as follows. A package comprising ferrite substance in the shape of pucks is placed on a piston—which corresponds to the fixing part of the above mentioned abstract—which has then been guided into a waveguide through a hole in a waveguide wall. The piston is movable in the hole in the waveguide wall, with the appropriate clearance fit, and a spring element presses the piston towards the package with the ferrite pucks so that this package is held in place in the waveguide, between the piston and the opposite waveguide wall. In this way the mounting becomes insensitive to variations in the dimensions of the package and the piston. The spring coefficient and the initial tension of the spring element have been chosen in such a way that the spring element can compensate for changes in the dimension caused by temperature variations without too high tension or play arising.

This circulator however also has disadvantages. The piston and the body of the waveguide house can sometimes lack a good galvanic contact with each other. This causes the electrical properties of the circulator to be somewhat impaired—first and foremost regarding insertion loss. As the piston can move in the hole with the appropriate clearance fit and is not fixed, it becomes somewhat sensitive to mounting (loose) as it is not always perfectly centred in the hole. There may also be a certain risk that the electrical performance of the circulator is affected by blows and vibrations.

DESCRIPTION OF THE INVENTION

The present invention is intended to solve the following problem: Firstly to provide a circulator for which the mounting is simple and insensitive and for which the requirements on the dimensions of the comprised parts are reasonable. Secondly the performance of the circulator regarding galvanic contact between the parts, frequency properties, insertion loss, reflection and isolation must be good. Thirdly the circulator must be able to take vibrations, blows and large variations in temperature without being damaged and without the performance being significantly reduced.

In general terms, the problems are solved as follows. A package comprising a ferrite substance in the shape of a puck is arranged at a movable and electrically conductive element. A portion of the movable element is found in a hole in one of the waveguide walls of the circulator and is slideable in this hole. The package with the ferrite material is kept in place in a waveguide between the movable element and a waveguide wall, the waveguide wall being opposite to the waveguide wall at which the hole is located. At the portion of the movable element which is located in the hole, one or more sections have been made deformable in the direction towards the wall of the hole. One or more press elements have been designed to press limited ranges of the deformable sections towards the wall of the hole. According to the invention it is further suggested that the distance between these limited ranges and the waveguide wall in which the hole is positioned is substantially equal to half the working wavelength of the circulator, whereby the circulator obtains particularly good electrical properties. The object of the invention is thus that when the limited ranges are pressed towards the wall of the hole a good mechanical and galvanic contact will arise between the movable element and the wall of the hole.

More specifically the above listed problems are solved according to the following. As a suggestion, the movable element is made up of a tubular metal piston. The shape of the piston corresponds to the shape of a hole in a waveguide wall, and the piston is, in whole or in part, arranged in this hole. The piston comprises a first end which as a suggestion is closed, so that a package of ferrite substance in the shape of a puck can be placed at this end. The package is kept in place in the waveguide between the first end of the piston and an opposite waveguide wall. The other end of the piston is open and provided with slits which as a suggestion extend substantially in the longitudinal direction of the piston. Because of the slits, the edge of the tube at the open end of the piston can be deformed in relation to the rest of the piston in the direction towards the wall of the hole. The tube edge can however not be deformed in relation to the rest of the piston in the longitudinal direction of the hole. A press element lies close to the tube edge at the other end of the piston. It is suggested to place the surface of the press element that is close to the tube edge at such an angle that the press element exerts a force on the tube edge both in the longitudinal direction of the hole and in the direction towards the walls of the hole, whereby the piston is pressed in the direction towards the package with the ferrite substance while the tube edge is pressed towards the wall of the hole. The press element can, for a piston with a circular cross-section, as a suggestion be a screw with a conical top, which conical top is intended to lie in contact with the tube edge. The hole in the waveguide wall is, for example, equipped with threads corresponding to the threads of the screw so that the screw can be inserted in the direction towards the tubular piston. The screw will here be screwed with a well defined momentum so that the package is brought into good contact with the opposite waveguide wall without at the same time exposing the ferrite substance to too high compressive stress.

The invention has, in addition to solving the above listed problems, the advantage that the mounting becomes relatively simple and cheap.

In the following, the invention will be described in more detail by means of preferred embodiments and with reference to the enclosed drawings.

PREFERRED EMBODIMENTS

In the following, with reference to FIG. 1, an example of a favourable embodiment of a circulator according to the invention is described. The circulator 100 in the example is a 3 port circulator. The ports on such a circulator are located at regular intervals around the circumference of the circulator, 120° apart. The cross section shown in the figure runs through the central point of one of the ports and the centre of the circulator.

Figure 1:
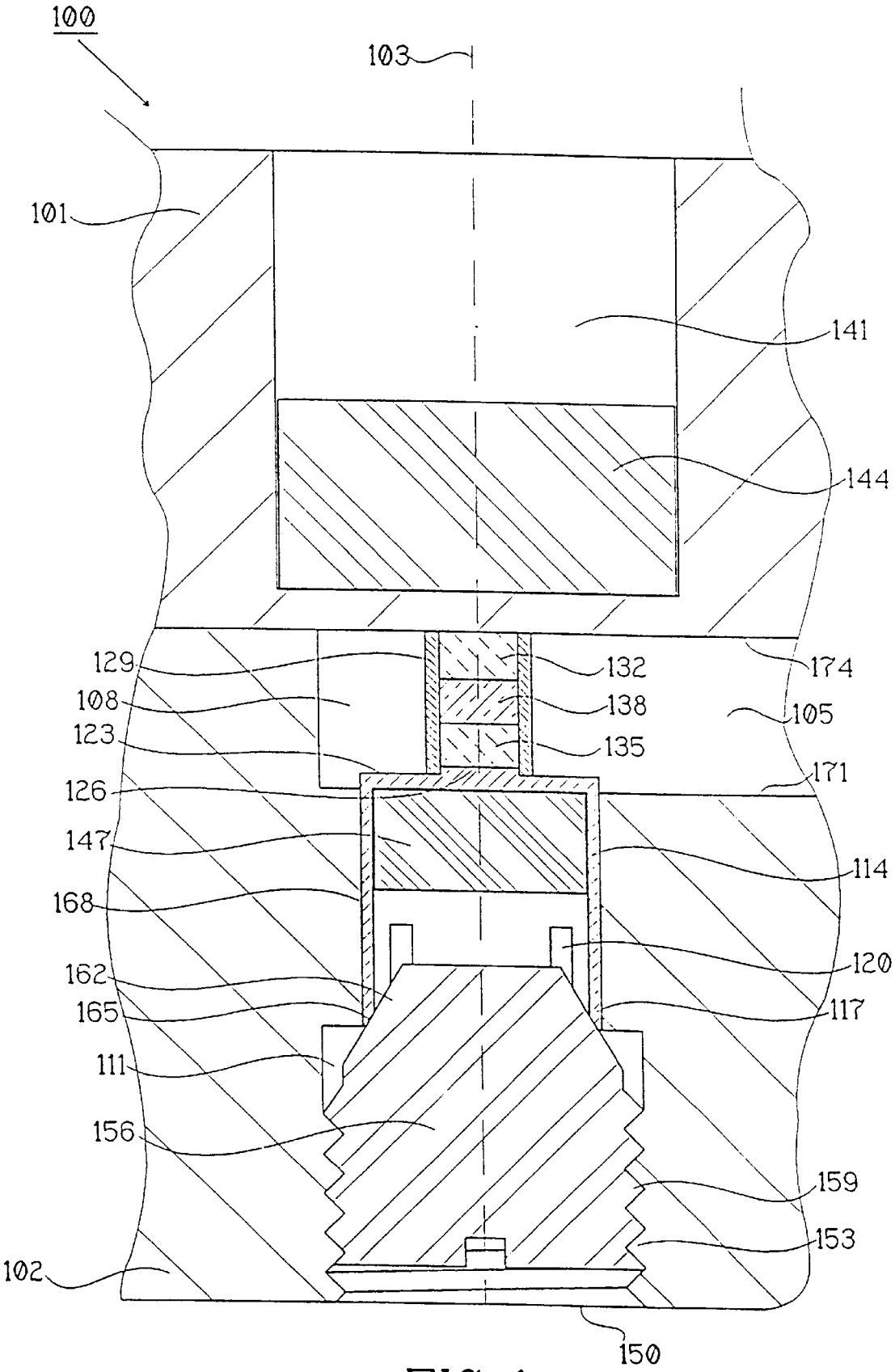
FIG. 1 is a cross-section of a first circulator construction in accordance with the invention.

The circulator comprises a waveguide house, and in the embodiment shown in FIG. 1 the waveguide house comprises two blocks, an upper part 101 and a lower part 102. These parts 101 and 102 are joined together in a suitable manner, for example with glue or with a screw union. The waveguide house is manufactured in an electrically conductive material, for example a metal. From the central axis 103 of the circulator three grooves with rectangular cross sections extend in the lower part.

The three grooves are 120° apart. Together with the lower side of the upper part 101 the three grooves constitute waveguides which make up the ports of the circulator. In the figure, the reference number 105 denotes such a port. This space may be given different shapes depending on the manufacturing method and the desired properties of the circulator 100.

In the lower part 102 there is a hole 111 in which a movable element 114 may be moved with the appropriate clearance fit. The movable element 114 is shown in FIG. 1 as a tubular metal piston 114. The hole 111 and the piston 114 in the example shown here have circular cross sections.

The end 117 of the piston facing away from the space 108 is open and provided with slits 120, which in the figure extent parallel to the central axis of the piston. The slits 120 divide the open end 117 of the piston 114 into a number of beam shaped sections. By selecting the dimension, positioning and number of the slits 120 in a suitable way, these sections have been made to be deformable in the direction towards the wall of the hole 111. The end 123 of the piston 114 which is close to the space 108 is closed and enters the space 108 by a certain distance. This end 123 of the piston therefore serves as a radial transformer, which transformer, with suitable height and diameter adjusts the circulator impedance to the impedances of the waveguides connected to the waveguide ports.

On the upper side of the end of the piston close to the space 108 there is an elevated portion 126. This elevated portion determines, with a high degree of accuracy, the position of a casing 129 with thin walls, by making the inner diameter of the casing correspond to the diameter of the elevated portion. The casing 129 is manufactured in a dielectric material which is also relatively resilient.

Inside the casing two cylindrical—puck-like—ferrite parts 132 and 135 are placed. These ferrite pucks 132 and 135 are separated by a dielectric puck 138 which is also cylindrical. The length of the casing 129 is to correspond to the added height of the elevated portion 126, the ferrite pucks 132 and 135 and the dielectric puck 138.

In a cavity 141 in the upper part 101 there is a magnet 144 which, together with a magnet 147 placed inside the tubular piston 114, creates a magnetic flux through the ferrite pucks 132 and 135.

The hole 111 in the lower part 102 is a through hole and has an exit 150 on the lower side of the lower part. The hole 111 is provided at the exit 150 with threads 153 which extend a bit into the hole. A press element in the shape of a screw 156 with corresponding threads 159 is screwed into the hole 111. The screw 156 has a conical top 162 which lies in contact with the edge 165 of the open end 117 of the tubular piston. To improve the contact, the edge 165 has a bevelling with a shape corresponding to the shape of the conical top 162.

The conical top 162 presses the piston 114 in the direction of the hole 111, and the piston therefore in turn presses the upper ferrite puck 132 towards the upper part 101, whereby good mechanical contact, and thus also good thermal and galvanic contact, is achieved between the upper part, the pucks and the piston. If, because of disadvantageous aggregation of maximum tolerances, the upper end of the casing 129 would extend past the ferrite puck 132 which is closest to the upper part 101, the casing will, because it has been manufactured in a relatively resilient material, be somewhat deformed, so that even in the most disadvantageous case the ferrite puck 132 will be in contact with the upper part 101. In the opposite situation, the end of the casing 129 will not reach the upper part 101, but this will in practice not affect the function.

The slits 120 divide, as previously stated, the open end 117 of the piston 114 into a number of beam shaped sections, which are deformable in the direction towards the wall of the hole 111. The edge 165 of the open end 117 here constitutes a limited area of these deformable sections. When the conical top 162 presses against the edge 165, this edge will be pressed out against the walls of the hole 111, whereby a very good mechanical and galvanic contact is achieved between the edge 165 and the material in the wall of the hole.

The good galvanic contact between the piston 114 and the material in the wall of the hole gives the circulator 100 improved electrical characteristics, primarily regarding insertion loss, but also regarding reflection and isolation. The good mechanical contact makes sure the piston 114 is centred well in the hole 111, so that the circulator 100 becomes easier to mount and can take blows and vibrations to a larger extent without its electrical performance being affected too much.

It is possible that microwave signals can propagate in the gap 168 between the piston 114 and the walls of the hole 111. The edge 165 of the open end 117, however, lies tight against the wall of the hole 111, so that this area of the piston can be seen as a short circuit. The microwave signals are reflected in this short circuit and this may result in resonance effects which might impair the performance of the circulator 100. To avoid this according to the invention it is proposed to dimension the parts comprised in the circulator 100 in such a way that the distance between the waveguide wall 171 in the lower part 102 and the edge 165 substantially corresponds to half the wavelength ($\lambda/2$) of the working wavelength of the circulator. The microwaves will then first propagate a distance of half a wavelength, then will be reflected and go back a distance half a wavelength, that is, in total one whole wavelength. This may be seen as the short circuit at the end of the piston where the slits are, is transformed up to the waveguide wall. In the microwave range, this corresponds to the situation where the gap 168 does not exist. Of course it works just as well if the distance between the wavelength wall 171 and the edge 165 substantially corresponds to an arbitrary integer number of half wavelengths ($N*\lambda/2$).

When the temperature varies, the dimensions of all components comprised in the circulator will change according to the coefficient of linear expansion of each substance. Temperature variations might therefore create so high compressive stress on the ferrite pucks 132 and 135 that they might be damaged. Of course also the opposite can occur, that is the compressive stress drops so that the contact between the upper ferrite puck 132 and the upper part 101 is not good enough. To make sure that none of this happens, it is suggested according to the invention to manufacture the dielectric puck 138 in a dielectric material which is also relatively resilient. This puck 138 can then be deformed and thereby compensate for the changes in dimensions of the other components, without the compressive state of the ferrite pucks 132 and 135 being affected.

When the arrangement according to the embodiment described above is used, the mounting will be accurate and easy to perform. The magnet 147 is glued in place in the tubular piston 114. The casing 129 is pressed on to the elevated portion 126, which keeps the casing in place. The pucks 132, 135 and 138 are placed in the casing 129, where they are kept in place by the magnet. The open end 117 of the piston 114, which has the slits, is then placed on the conical top 162 of the screw 156, and the assembly is introduced so far into the hole 111 that the screw can be screwed in. The screw 156 is screwed until the casing 129 and the upper ferrite puck 132 touch the waveguide wall 174 in the upper part 101. Screwing in the screw then continues until a well defined torque is achieved, which torque has been chosen so that a suitable pressure is achieved between the upper part 101 and the ferrite puck 132 which touches this part.

Figure 2:
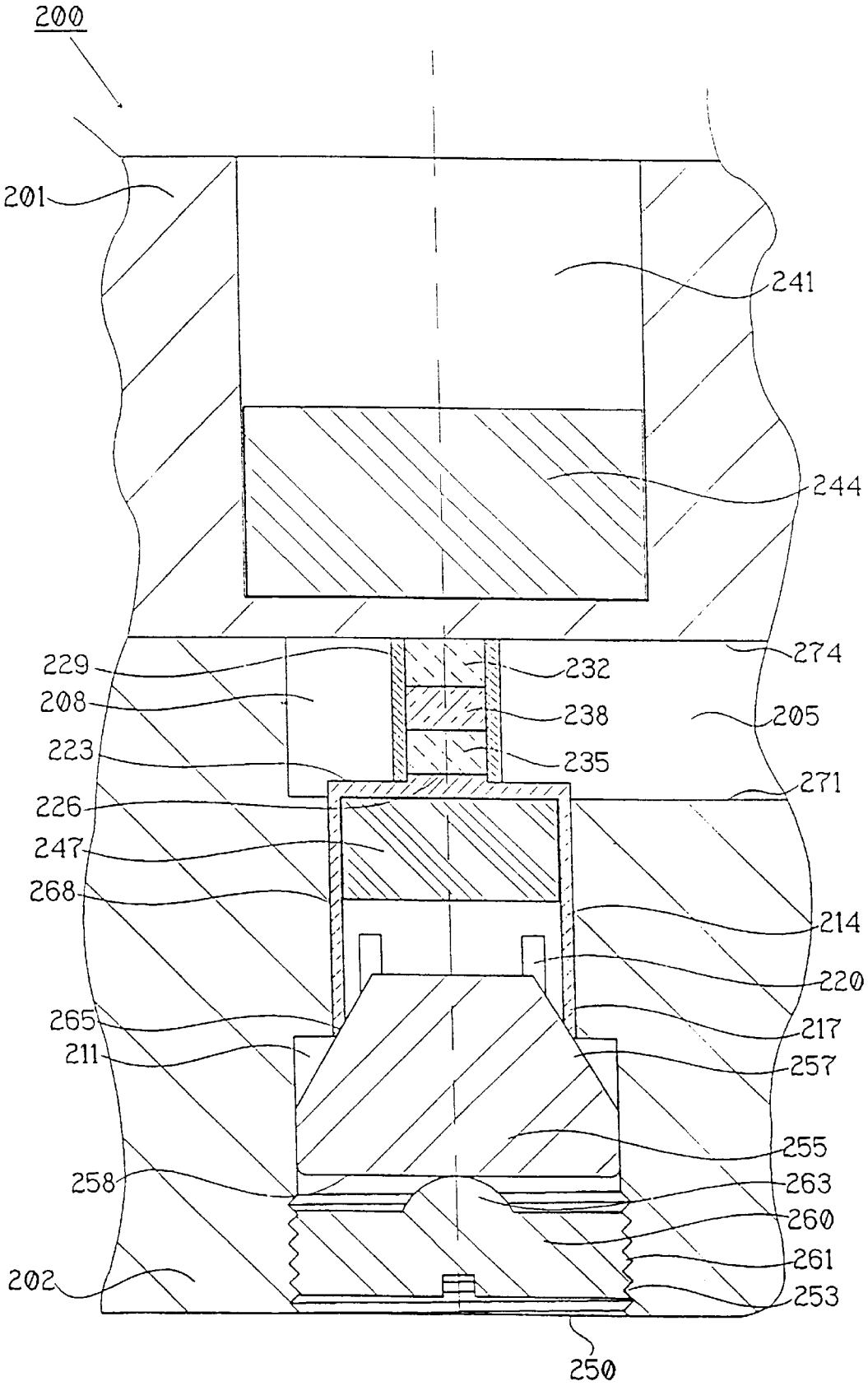
FIG. 2 is a cross-section of a second circulator construction in accordance with the invention.

In FIG. 2 another embodiment of a circulator 200 according to the invention is shown. The circulator 200 in FIG. 2 shows major similarities with the one in FIG. 1 and therefore primarily the differences are described. The parts that are the same in the two embodiments are only described very briefly or omitted from the description. Features on the circulator 200 that are similar to features on the circulator 100 are assigned corresponding reference numbers, increased by 100.

A piston 214, drawn in FIG. 2 in the same way as the piston in FIG. 1, is arranged in a hole 211 corresponding to the hole 111 in FIG. 1. Just like in FIG. 1, a casing 229, two ferrite pucks 232 and 235 and a dielectric puck 238 are held in place in a space 208 between the piston 214 and an upper part 201. The hole 211 has, just like the hole 111 in FIG. 1, an exit on the lower side of a lower part 202 and threads 253 extend from this exit 250 into the hole 211.

The screw 156 in FIG. 1 has been replaced with two parts, a contact element 255 and a twist-on cap 260.

The contact element 255 is arranged in the hole 211 with the appropriate clearance fit and has conical upper side 257 and a plane under side 258. The conical upper side 257 lies in contact with the edge 265 of the open end 217.

The twist-on cap 260 is provided with threads 261 corresponding to the threads 253 in the hole 211 and is also screwed into these threads. The side of the twist-on cap 260 facing the contact element 255 is provided with a convex part 263 and this convex part lies in contact with the plane underside 258 of the contact element 255. The convex part 263 of the twist-on cap 260 is made so that the twist-on cap and the contact element 255 can easily be turned relative to each other without any significant torque arising between these parts. The twist-on cap 260 thus presses the contact element 255 in the longitudinal direction of the hole 211 and the contact element in turn presses against the edge 265 of the end of the piston 214 where the slits are.

The parts comprised in the circulator 200 are, just as in the circulator 100 in FIG. 1, dimensioned in such a way that the distance between the waveguide wall 271 in the lower part 202 and the edge 265 of the open end 217 substantially corresponds to half the wavelength ($\lambda/2$) of the working wavelength of the circulator 200.

To compensate for changes in dimensions resulting from variations in temperature, the dielectric puck 238 may, just as in the circulator 100 of FIG. 1, be manufactured in a relatively resilient material.

The mounting of the embodiment in FIG. 2 becomes precise and easy to perform. The casing 229, the magnet 247 and the pucks 232, 235 and 238 are mounted at the piston 214 in a corresponding way as with the circulator 100 of FIG. 1. The open end 217 of the piston 214 is placed on the conical upper side 257 of the contact element 255. The piston 214, the casing 229, the pucks 232, 235 and 238 and the contact element 225 are then introduced into the hole 211 through the exit 250. The convex part 263 of the twist-on cap 260 is brought in contact with the underside 258 of the contact element 255, and the twist-on cap is twisted into the hole 211 until the casing 229 and the upper ferrite puck 232 touch the waveguide wall 274 in the upper part 201. The twisting on of the twist-on cap 260 then continues until a well-defined torque is achieved, which torque has been selected so that the pressure between the upper part 201 and the ferrite puck 232 touching this part obtains a reasonable value.

The piston 214 and the hole 211 have circular shapes in the circulator 200 shown in FIG. 2. With a couple of minor modifications the circulator construction of FIG. 2 will however allow other shapes of the piston and the hole—which the circulator of FIG. 1 does not allow.

For example, the piston may be given a rectangular cross-section and the modifications needed for this are the following.

The portion of the hole in which the rectangular piston is to be arranged with the appropriate clearance fit, must of course have a corresponding rectangular shape. The rest of the hole does not need to have a rectangular shape, but must be dimensioned so that there is no risk that the piston will get stuck when the circulator is being mounted. The threaded portion of the hole must however still have a circular shape, so that the twist-on cap may be put on.

The far end of the piston from the space is still open and has slits. It is however an advantage if the slits have been placed in the corners of the rectangle, as the edge of the open end in this case will be more easily deformed against the wall of the hole.

The upper side of the contact element may not be conical but instead may advantageously have a pyramid shape so that the upper side of the contact element can lie close to the edge of the open end, which is now rectangular. The shape of the contact element must in all other aspects be such that the contact element is arranged in the hole with the appropriate clearance fit.

Figure 3:
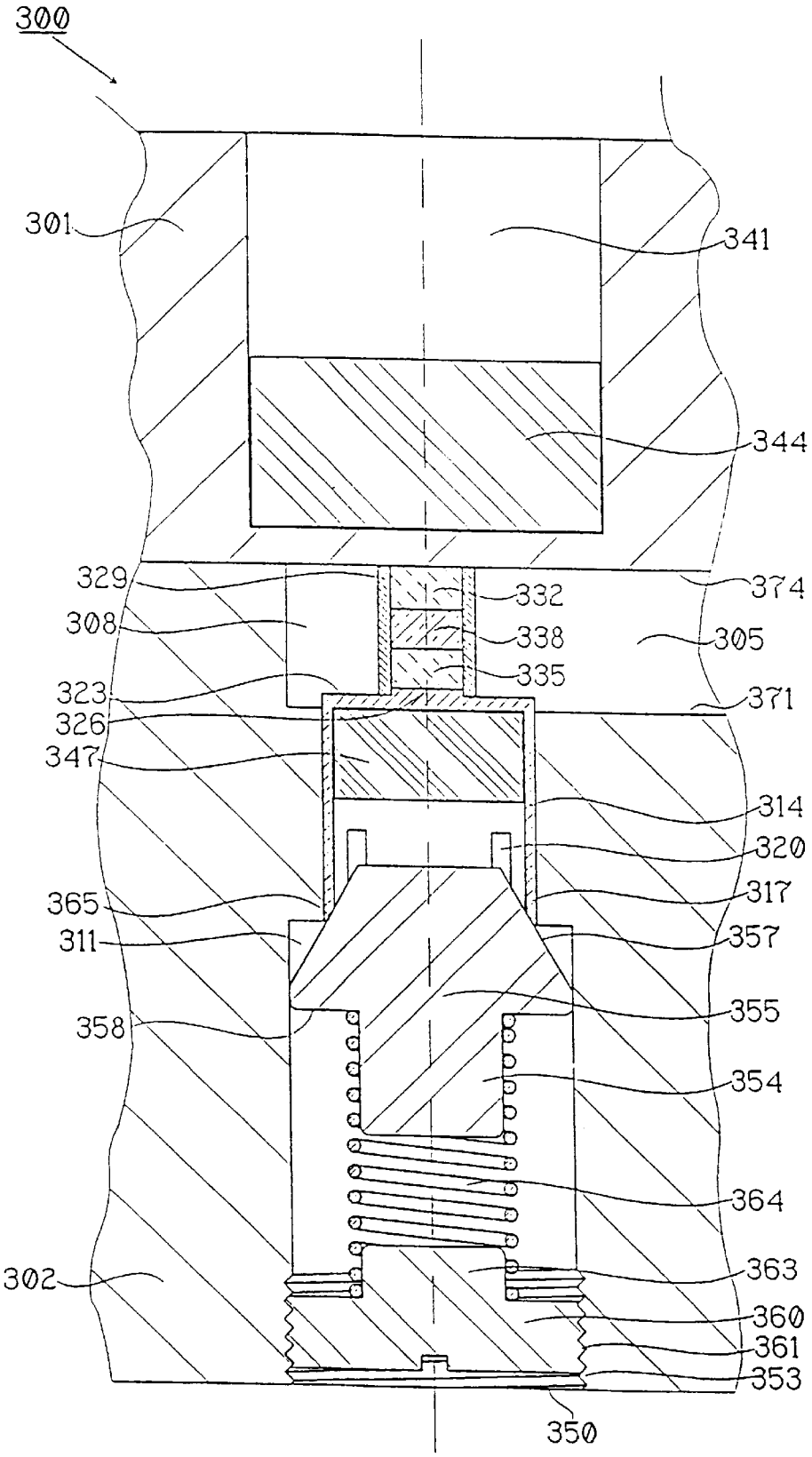
FIG. 3 is a cross-section of a third circulator construction in accordance with the invention.

In FIG. 3 yet another embodiment of a circulator 300 according to the invention is shown. This circulator 300 also has major similarities with the circulator 100 of FIG. 1, and therefore primarily the differences will be described, whereas the similarities will be described briefly or omitted from the description. Features on the circulator 300 that are similar to features on the circulator 100 are assigned corresponding reference numbers, increased by 200.

A piston 314 in FIG. 3 drawn in the same way as the piston 114 of FIG. 1, is arranged in a hole 311 corresponding to the hole 111 of FIG. 1. Just like in FIG. 1 a casing 329, two ferrite pucks 332 and 335 and a dielectric puck 338 are held in place in a space 308 between the piston 314 and an upper part 301. The hole 311 has, just like the hole 111 in FIG. 1, an exit 350 on the underside of a lower part 302, and threads 353 extend from this exit 350 into the hole 311.

The screw 156 of the circulator 100 in FIG. 1 has in the circulator 300 of FIG. 3 been replaced with three parts: a contact element 355, a twist-on cap 360 and a coil spring 364.

The contact element 355 has a conical upper side 357 which lies in contact with the edge 365 of the open end 317 of the piston 314. The underside 358 of the contact element 355 is provided with a protruding part 354 with a circular cylindrical shape. This protruding part 354 is positioned so that its centre line coincides with the centre line of the conical upper side 357.

The twist-on cap 360 is provided with threads 361 corresponding to the threads 353 in the hole 311 and is screwed into the hole. The side of the twist-on cap 360 which faces the contact element 355 is provided with a protruding part 363 with a circular cylindrical shape. This protruding part 363 has the same diameter as the protruding part 354 of the underside 358 of the contact element 355.

The coil spring 364 has an inner diameter corresponding to the diameters of the two protruding parts 354 and 363 and with one end lies in contact with the underside 358 of the contact element 355 and with its other end to the side of the twist-on cap 360 facing the contact element 355. The coil spring here encloses the two protruding parts 354 and 363, whereby the coil spring 364 is prevented from moving perpendicularly to the longitudinal direction of the hole 311. The coil spring 364 is partially compressed and thus exerts a force between the twist-on cap 360 and the contact element 355. The contact element 355 is therefore pressed against the edge 365 of the open end 317 of the piston 314.

The parts comprised in the circulator 300 are, just as in the circulator 100 of FIG. 1, dimensioned in such a way that the distance between the waveguide wall 371 in the lower part 302 and the edge 365 of the open end 317 substantially corresponds to half the wavelength of the wavelength intended for the circulator.

The coil spring can be deformed and thus compensate for size changes brought on by temperature variations, in the components comprised in the circulator 300, without significantly affecting the compressive states of the pucks 332, 335 and 338. The circulator 300 can therefore take large variations in temperature without any risk that the ferrite pucks 332 and 335 will be damaged or that the performance of the circulator 300 is deteriorated in other aspects. As the coil spring 364 compensates for changes in size, the dielectric puck 338 can be of a ceramic substance.

The mounting of the embodiment of FIG. 3 becomes precise and simple to perform. The casing 329, the magnet 347 and the pucks 332, 335 and 338 are assembled with the piston 314 in a corresponding way as for the circulator 100 of FIG. 1. The open end 317 of the piston, which has the slits, is placed on the conical upper side 357 of the contact element 355. One end of the coil spring 364 is placed around the protruding part 354 on the lower side 358 of the contact element 314. The contact element 355 and the coil spring are introduced through the exit 350 so far into the hole that the casing 329 and the pucks 332, 335 and 338 get in contact with the upper part 301. The other end of the coil spring is placed around the protruding part 363 of the twist-on cap 360, and the twist-on cap is introduced in the exit 350 so that it can be twisted on. The twist-on cap 360 is twisted a predetermined number of turns. The number of turns has been selected with respect to the sizes of the circulator components and the spring coefficient of the coil spring 364, so that the pressure between the upper part 301 and the ferrite puck 332 lying in contact with the upper part 301 obtains a suitable value.

The circulator 300 of FIG. 3 can, if it is modified, also be used if the piston and the hole are not circular.

For example, the piston may have a rectangular cross-section. Corresponding modifications may also be made for the circulator of FIG. 2.

Above a couple of beneficial embodiments of the invention have been described. Other embodiments are of course possible. The ferrite and dielectric pucks, which have been given a circular shape in the embodiments described above, can of course have another shape, for example triangular. Depending on the desired electrical properties the distribution and the placement of the pucks may be varied. In some applications for example dielectric pucks may be completely left out. The shape of the dielectric casing must be adapted to these modifications, but as the task of the casing is primarily to keep the pucks together it can in some applications be left out or replaced with, as an example, glue. The coil spring 364 of FIG. 3 can of course be replaced with another spring, for example a spring clip.

I claim:

1. A waveguide circulator for frequencies in the microwave range and higher, comprising:

a ferrite puck;

an electrically conductive waveguide housing having a plurality of waveguide ports, a wall, an area receiving said ferrite puck, and a hole located in the wall, said hole having an inner surface;

an electrically conductive piston having an end surface facing said ferrite puck, being movable toward said ferrite puck, being located in said hole, and having a deformable section, said deformable section having an exterior surface located at an angle with respect to said end surface;

a magnetic field generating device located adjacent to said ferrite puck so that said ferrite puck is subjected to a magnetic flux; and a press device movable to press at least a portion of said deformable section having said exterior surface against said inner surface of said hole.

2. The waveguide circulator of claim 1, wherein said piston is tubular.

3. The waveguide circulator of claim 2, wherein said deformable section includes a plurality of slits formed in said tubular piston.

4. The waveguide circulator of claim 1, wherein said hole is cylindrical.

5. The waveguide circulator of claim 1, wherein said wall has an opening into said hole and said piston extends out of said hole.

6. The waveguide circulator of claim 1, wherein said press device is a screw threaded into said waveguide housing.

7. The waveguide circulator of claim 1, further comprising a cap threadable into said housing to move said press device.

8. The waveguide circulator of claim 7, further comprising a spring located between said press element and said cap.

9. The waveguide circulator of claim 1, wherein the magnetic field generating device includes at least one magnet located in the waveguide housing.

10. The waveguide circulator of claim 1, wherein a distance between said waveguide wall of said waveguide housing and an edge of said piston opposed from said ferrite puck substantially corresponds to a predetermined integer multiple of half a working wavelength of the waveguide circulator.

11. The waveguide circulator according to claim 1, wherein said magnetic field generating device includes a magnet and said piston includes an interior holding said magnet.

12. The waveguide circulator according to claim 1, wherein said piston has a hollow interior portion and a plurality of slits, said slits defining at least a portion of said deformable section.

13. The waveguide circulator according to claim 1, wherein said end surface of said piston abuts said ferrite puck.

14. The waveguide circulator according to claim 1, wherein said press device includes a conical exterior surface for pressing said portion of said deformable section.

15. The waveguide circulator according to claim 1, wherein said hole communicates said area receiving said ferrite puck with an area external of said waveguide housing.

16. A waveguide circulator for frequencies in the microwave range and higher, comprising:

a magnetic field generating device;

an electrically conductive waveguide housing having a plurality of waveguide ports, a wall having a hole therein, and an area for receiving a ferrite puck, said hole opening into said area for receiving said ferrite puck and having an interior surface;

an electrically conductive piston movable toward said area, located in said hole, and having a deformable section; and means for pressing at least a portion of said deformable section of said piston toward said interior surface of said hole.

17. The waveguide circulator of claim 16, further comprising a ferrite puck located in said area.

18. The waveguide circulator of claim 17, further comprising means for subjecting said ferrite puck to a magnetic flux.

19. The waveguide circulator of claim 18, wherein said magnetic flux generating means includes at least one magnet.

20. The waveguide circulator according to claim 16, wherein said piston includes a plurality of slits, said slits defining at least a portion of said deformable section.

21. The waveguide circulator according to claim 16, wherein said piston includes a cylindrical exterior surface and a hollow interior.

22. The waveguide circulator according to claim 16, further comprising a magnet, said piston including a hollow interior for receiving said magnet.

23. A waveguide circulator for frequencies in the microwave range and higher, comprising:

a first magnet;

a second magnet spaced from said first magnet;

a ferrite puck located between said first magnet and said second magnet;

an electrically conductive waveguide housing having a plurality of waveguide ports;

an electrically conductive piston located in a hole in said waveguide housing and being moveable in said hole, said piston having a deformable section and a hollow interior, one of said first magnet and second magnet being located in said hollow interior of said piston; and a press device movable to press at least a portion of said deformable section toward an interior surface of said hole.

24. A waveguide circulator for frequencies in the microwave range and higher, comprising:

a ferrite puck;

a magnetic field generating device;

an electrically conductive waveguide housing having a plurality of waveguide ports, a wall having a hole therein, and an area in which said ferrite puck is located;

an electrically conductive piston moveable toward said area, said piston having a hollow interior; and a press device movable to press at least a portion of said piston toward a wall of said hole.

25. The waveguide circulator according to claim 24, wherein said magnetic field generating device includes a magnet located within said hollow interior of said piston.

26. A waveguide circulator, comprising:

a ferrite member;

at least one magnet;

a waveguide housing having a plurality of waveguide ports, an area that receives said ferrite member, and a hole;

a piston located in said hole and being movable in a first direction toward said ferrite member; and a device movable to press at least a portion of said piston in a second direction that is different than said first direction and toward a surface of said hole.

* * * * *